US011313385B1

(12) United States Patent
Evans et al.

(10) Patent No.: US 11,313,385 B1
(45) Date of Patent: Apr. 26, 2022

(54) ADJUSTABLE SUB-BASE MOUNTING ASSEMBLY FOR INSTALLING A PUMP

(71) Applicants: Thomas R. Evans, Lakeland, FL (US); Dennis Szczepanek, Zephyrhills, FL (US); John Ruddell, Palm Coast, FL (US)

(72) Inventors: Thomas R. Evans, Lakeland, FL (US); Dennis Szczepanek, Zephyrhills, FL (US); John Ruddell, Palm Coast, FL (US)

( * ) Notice: Subject to any disclaimer, the term of this patent is extended or adjusted under 35 U.S.C. 154(b) by 310 days.

(21) Appl. No.: 16/723,472

(22) Filed: Dec. 20, 2019

(51) Int. Cl.
*F04D 29/60* (2006.01)
*E02D 27/44* (2006.01)
*E02D 27/52* (2006.01)

(52) U.S. Cl.
CPC ..... *F04D 29/605* (2013.01); *E02D 27/44* (2013.01); *E02D 27/52* (2013.01); *F05B 2230/604* (2013.01); *F05B 2230/80* (2013.01); *F05B 2240/97* (2013.01)

(58) Field of Classification Search
CPC ..... F04D 29/605; E02D 27/44; E02D 27/52; F05B 2230/80; F05B 2240/97
See application file for complete search history.

(56) References Cited

U.S. PATENT DOCUMENTS 3,618,236 A 11/1971 Pipkin
4,165,571 A 8/1979 Chang et al.
5,417,553 A 5/1995 Gibson et al.
7,156,614 B2 1/2007 Racer et al.
7,713,031 B2 5/2010 Dane
10,001,143 B2 * 6/2018 Yoshida ..... F04D 17/10
10,233,945 B2 * 3/2019 Yoshida ..... F04D 17/122

OTHER PUBLICATIONS

FLYGT Horizontal Installation Publication, The Dry- Z installation of pump models 3231-3800.
FLYGT Horizontal Installation Publication, Dry-Z installation of pump models 3085-3127.
FLYGT Horizontal Installation Publication, Dry-Z installation of pump models 3153-3315.

* cited by examiner

*Primary Examiner* — Anita M King
(74) *Attorney, Agent, or Firm* — Malloy & Malloy, P.L.

(57) ABSTRACT

An adjustable sub-base mounting assembly for installing a pump onto a concrete base includes a track assembly having at least one upper track member, wherein one or more cradles supporting the pump are mounted to a portion of the upper track member. The track assembly includes at least one lower track member disposed in sliding engagement with the upper track member(s) to allow the pump to be movable via the track assembly. A sub-base assembly has a sub-base and at least one track support member, the lower track member(s) secured to the track support member. The adjustable sub-base mounting assembly includes one or more one jacking bolts to adjustably secure the track support member(s) to the sub-base, allowing for adjustable positioning of the track support member(s) relative to the sub-base, thereby permitting precise alignment of the rotating unit with the volute of the pump.

20 Claims, 5 Drawing Sheets

ADJUSTABLE SUB-BASE MOUNTING ASSEMBLY FOR INSTALLING A PUMP

BACKGROUND OF THE INVENTION

Field of the Invention

The present invention is directed to an adjustable sub-base assembly for installing a pump in a pump station which permits precise alignment of a rotating unit with a volute of a pump. The present invention may be utilized with advantage for the installation of high capacity submersible pumps into a "dry-pit" raw sewage pump station, wherein a high capacity submersible pump is installed horizontally onto a concrete base.

Description of the Related Art

It is well known that many of the high capacity water and wastewater processing and booster pumps installed in pump stations are so large and so heavy that when they require periodic maintenance and/or repair, which typically requires opening the pump casings to inspect impellers and unclog pumps, considerable time and often considerable manpower are required to manipulate the pumps and motors, drop the couplings, and service the pumps. The sheer magnitude of the effort required to perform the even routine maintenance often delays or even prevents pump crews from performing timely maintenance on these types of pumps. It is equally well known that upon completion of even the most routine of maintenance procedures on such large, high capacity water and wastewater pumps, the alignment of pump and motor, and more importantly, the alignment of the rotating unit and volute of the pump are often disturbed, thus leading to a reduced operating efficiency of the pump, which may be substantial, and may also lead to an early, potentially catastrophic, failure of the pump itself, leading to even more time and expense.

Maintenance and repair operations aside, over time, the concrete bases onto which such high capacity water and wastewater pumps are often installed eventually settle over time which, in and of itself, or combined with shifting of the inlet and discharge piping to and from a pump station, respectively, likewise can lead to a misalignment of the rotating unit and volute, once again, resulting in a reduction in operating efficiency and/or failure of the pump.

Large, high capacity horizontal pumps are typically mounted on structural steel bases with motors mounted separately on one end and the pumps on the other end with a flexible coupling connecting the two together. The structural steel bases are typically large, robust, and grouted into place after the pump is set on its foundation. Grouting connects the fabricated steel bases to an essentially "infinite mass" in the earth below via a concrete base, which reduces the likelihood of damaging the rotating parts of the pump, even when challenged with clogging, typically occurring with wastewater applications.

As the manufacturers of large, high capacity submersible pumps have brought their products to market to be used not only in a traditional, submerged "wet-well" configuration but also, increasingly, to be mounted in "dry-pit" pump station environments, both vertically and horizontally, the market is now challenged with how to manipulate these machines which have become gigantic in size. High capacity "dry-pit" submersible pumps are typically moved into and out of operational position via overhead cranes installed-in the pump station itself, wherein the crane(s) lift and move the motor and rotating unit away from the volute, which remains bolted in position to the intake and discharge piping, thereby allowing access to the rotating unit as needed for routine maintenance and/or repair.

When these large submersible pumps are installed in "dry-pit" applications with intake and discharge lines hard piped to and from the pump, the pumps are often mounted on a cradle that supports the pump and motor horizontally, and in some cases a skid, sled, or service cart is provided to allow the motor/rotating unit to slide backwards away from the pump volute in the event that the operator desires to service the impeller of the rotating unit.

These types of skid, sled or service cart systems have been in use in one form or another for some time, however, as simple as this appears to be and look for service, the heavy pumps, sitting on steel sliding assemblies, often covered with raw sewage, sliding "metal to metal" present significant challenges to manipulation of the pump for periodic routine maintenance. Many submersible pump manufacturers fabricate these types of skid, sled or service cart systems, however, until the present invention, nothing in the prior art addresses the aforementioned and significant shortcomings and the outright failure to provide ease of access to the rotating units of such high capacity "dry-pit" submersible pumps for routine maintenance and/or repair, or the proper alignment or realignment, as the case may be, of the rotating unit with a volute following such routine maintenance or repair.

SUMMARY OF THE INVENTION

The present invention is directed to an adjustable sub-base mounting assembly for installing a pump mounted into a pump station. In at least one embodiment, the present invention is utilized to install a pump onto a concrete base of a pump station, while allowing for precise alignment of a rotating unit and volute of the pump. As noted above, in at least one embedment, an adjustable sub-base mounting assembly is utilized to install a high capacity submersible pump into a "dry-pit" raw sewage pump station, wherein the high capacity submersible pump is installed horizontally onto a concrete base.

In at least one embodiment, an adjustable sub-base mounting assembly comprises a track assembly having at least one upper track member, and in another embodiment, a track assembly comprises a plurality of upper track members. At least one cradle is dimensioned and disposed to receive at least a portion of a pump operatively mounted therein, and in at least one further embodiment, a plurality of cradles are dimensioned and disposed to receive at least a portion of a pump operatively mounted therein. The one or more cradles are attached to the one or more upper track members, thereby interconnecting the pump to the track assembly of the present invention.

A track assembly in accordance with at least one embodiment of an adjustable sub-base mounting assembly of the present invention further comprising at least one lower track member disposed in a sliding engagement with a corresponding upper track member. In one further embodiment, a track assembly comprises a plurality of lower track members, wherein each of the plurality of lower track members is disposed in a sliding engagement with a different corresponding one of a plurality of upper track members.

The present invention further comprises a sub-base assembly having a sub-base and at least one track support member adjustably mounted to the sub-base. Each lower track member is secured to the at least one track support member, and at least one jacking bolt adjustably secures the at least one track support member to the sub-base. In at least one embodiment, a plurality of jacking bolts are utilized to adjustably secure the at least one track support member to the sub-base. More importantly, each jacking bolt allows for adjustable positioning of the at least one track support member relative to the sub-base, thereby allowing for precise alignment of a rotating unit with a volute of the pump.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

The present invention is directed to an adjustable sub-base mounting assembly for a pump, generally as shown as at 10 throughout the figures. In at least one embodiment, an adjustable sub-base mounting assembly 10 in accordance with the present invention is utilized to mount a pump onto a concrete base, such as may be found in pump stations, and more in particular, in "dry-pit" type raw sewage pump stations.

Figure 1:
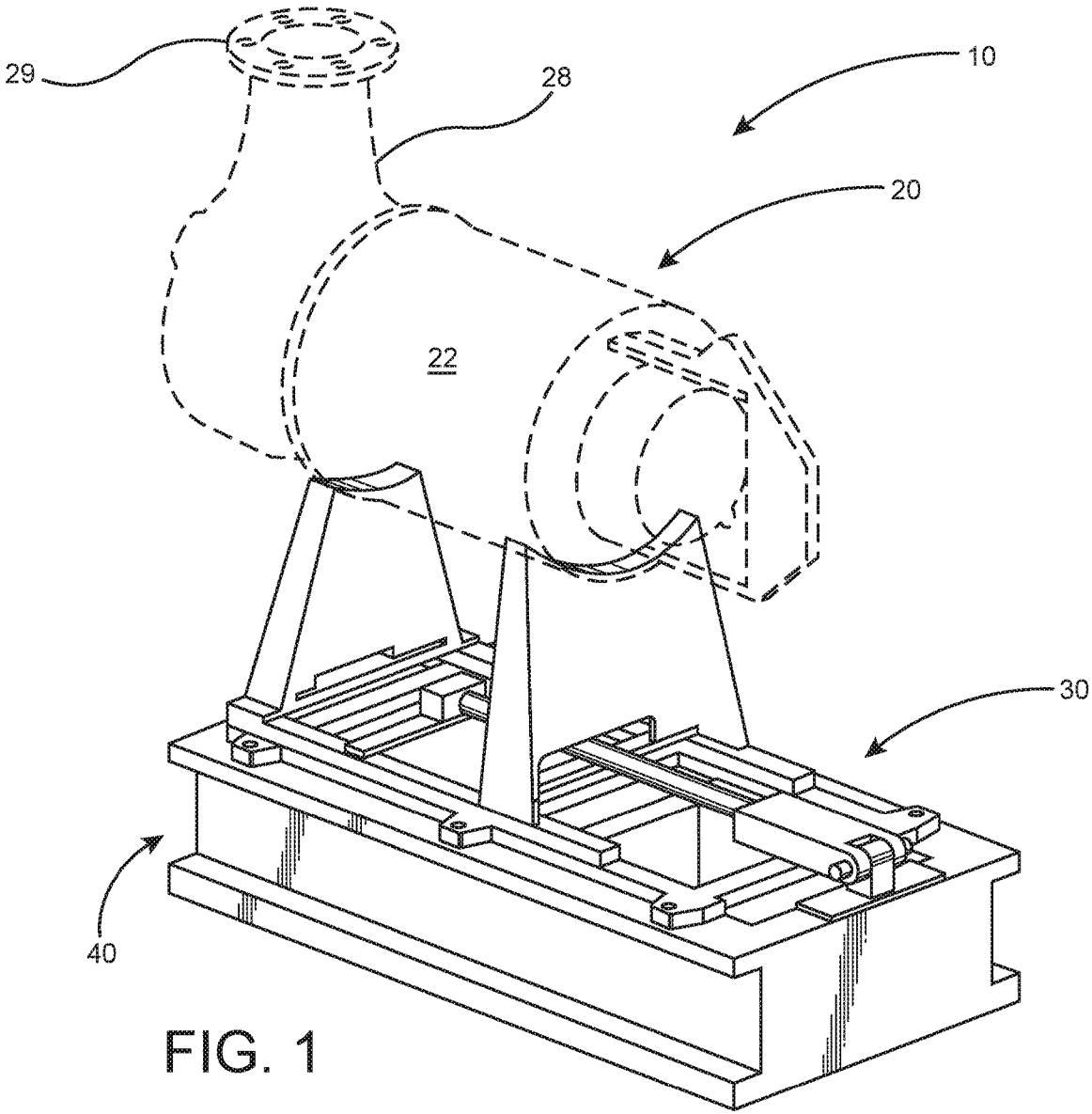
FIG. 1 is a perspective view of one illustrative embodiment of a pump installed on an adjustable sub-base mounting assembly in accordance with the present invention.

Looking first to the illustrative embodiment of FIG. 1, an adjustable sub-base mounting assembly 10 is shown having a pump 20 mounted thereupon. As may be seen from the illustrative embodiment of FIG. 1, the pump 20 comprises a motor 22 and a volute 28 mounted to one end thereof. FIG. 1 also shows the volute 28 includes a discharge flange 29 which, as will be appreciated by those of skill in the art, is securely attached to a discharge pipe (not shown) fixedly installed in a pump station and dimensioned to receive discharge flow from the pump 20 during operation. As previously stated, in accordance with at least one embodiment, an adjustable sub-base mounting assembly 10 in accordance with the present invention is intended for use with large submersible type pumps installed horizontally in corrosive "dry-pit" raw sewage applications. Although such large submersible pumps are not continuously immersed in raw sewage in a "dry-pit" environment, the pump 20 and its appurtenances, i.e., the adjustable sub-base mounting assembly 10, are subjected to corrosive raw sewage from time to time as a result of spillage which occurs upon separation of the volute 28 from the pump 20, such as is required for periodic maintenance and/or repair of a rotating unit 24. As shown best in the illustrative embodiment of FIG. 4, in accordance with at least one embodiment of the present invention, a rotating unit 24 comprises an impeller 25 which is operatively interconnected to a motor 22 of the pump 20 via a drive shaft 26.

As further shown in FIG. 1, an adjustable sub-base mounting assembly 10 in accordance with at least one embodiment of the present invention comprises a track assembly 30 onto which the pump 20 is mounted. FIG. 1 further illustrates at least one embodiment of a sub-base assembly 40 disposed in a supporting relation to a track assembly 30 in accordance with the present adjustable sub-base mounting assembly 10 for a pump.

Figure 2:
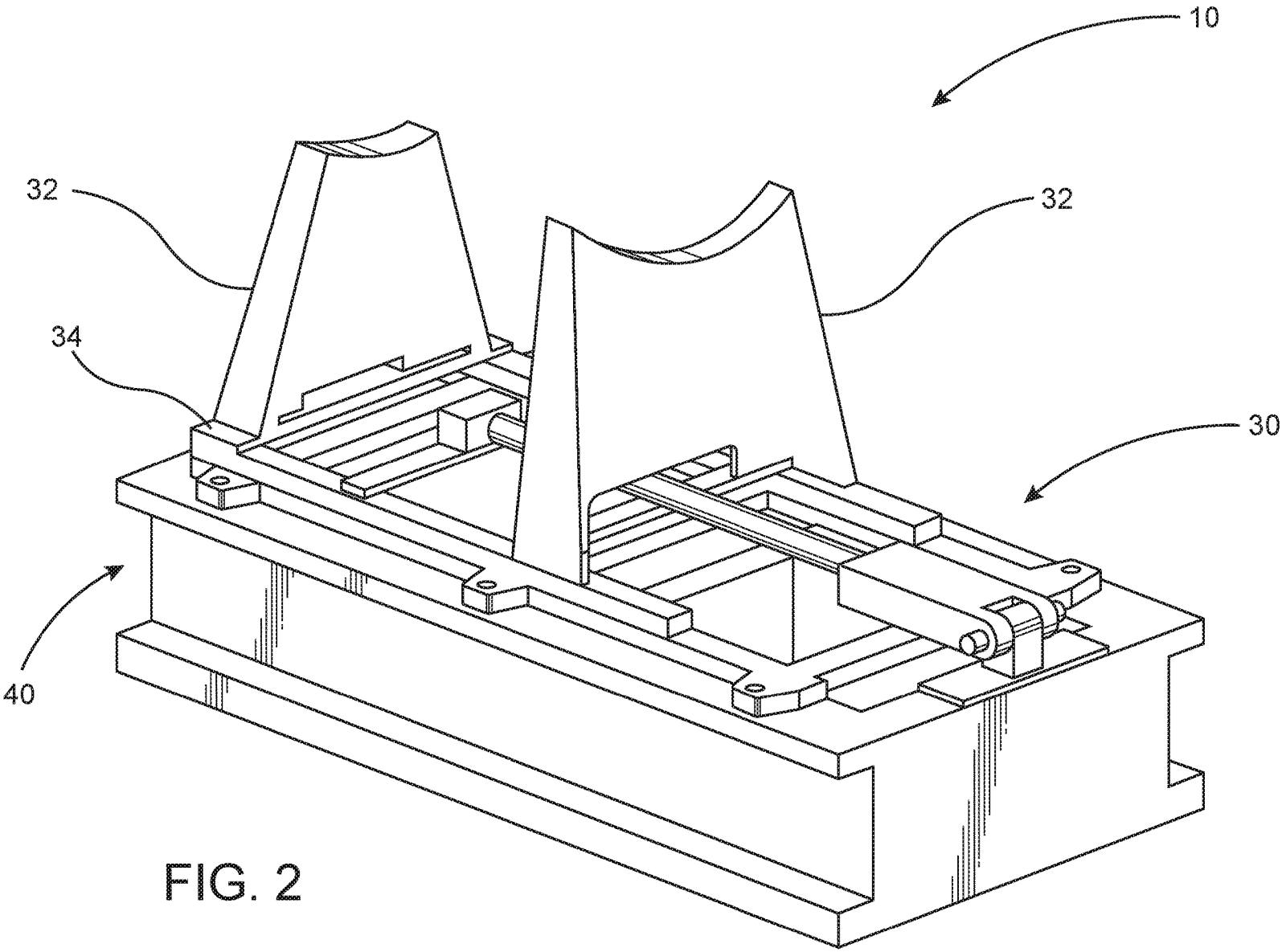
FIG. 2 is a perspective view of one illustrative embodiment of a track assembly and a sub-base assembly of an adjustable sub-base mounting assembly in accordance with the present invention.

In accordance with at least one embodiment of the present invention, a track assembly 30 comprises at least one cradle 32 dimensioned and disposed to receive a portion of a pump 20 in a supported relation therein. With reference to the illustrative embodiment of FIG. 2, a track assembly 30 comprises a plurality of cradles 32, wherein each of the plurality of cradles 32 are dimensioned and disposed to receive a different portion of a pump 20 in a supported relation therein. As will be appreciated by those of skill in the art, one or more cradles 32 are attached to a portion of a track assembly 30, such as, upper track member 34, thereby securely interconnecting the pump 20 to the track assembly 30 in accordance with at least one embodiment of the present invention. As will be further appreciated by those of skill in the art, one or more cradles 32 may be integral with a track assembly 30 of an adjustable sub-base mounting assembly 10 for a pump in accordance with the present invention, such as is shown throughout the figures. Alternatively, one or more cradles 32 may be specifically designed for and provided with a pump 20 by the manufacturer thereof, for subsequent attachment to a track assembly 30 of the present invention.

As noted above, at least one embodiment of the present invention includes one or more cradles 32, which are integral with a track assembly 30, or alternatively, which are provided separately with a pump 20 by the pump manufacturer for subsequent attachment to a track assembly 30. As before, one or more cradles 32 may be securely attached to a portion of an upper track member 34 in accordance with the present invention. More in particular, one or more cradles 32 may be integrally formed with an upper track member 34. Alternatively, one or more cradles 32 may be securely attached to portions of an upper track member 34 by mechanical means including, but not limited to, welding, mechanical fasteners, etc. As will be appreciated by those of skill in the art, an upper track member 34 in accordance with the present invention may be constructed from a variety of materials including, but not limited to, aluminum, steel, stainless steel, 316 stainless steel, engineered composite materials, etc., provided the selected material(s) exhibit sufficient structural strength to support a pump 20 thereon. In at least one embodiment, an upper track member 34 of a track assembly 30 in accordance with the present invention is constructed of heavy stainless steel having a low carbon content to withstand the corrosive environment in a raw sewage pump station. In at least one further embodiment of the present invention, an upper track member 34 is constructed of 316 stainless steel.

Figure 3:
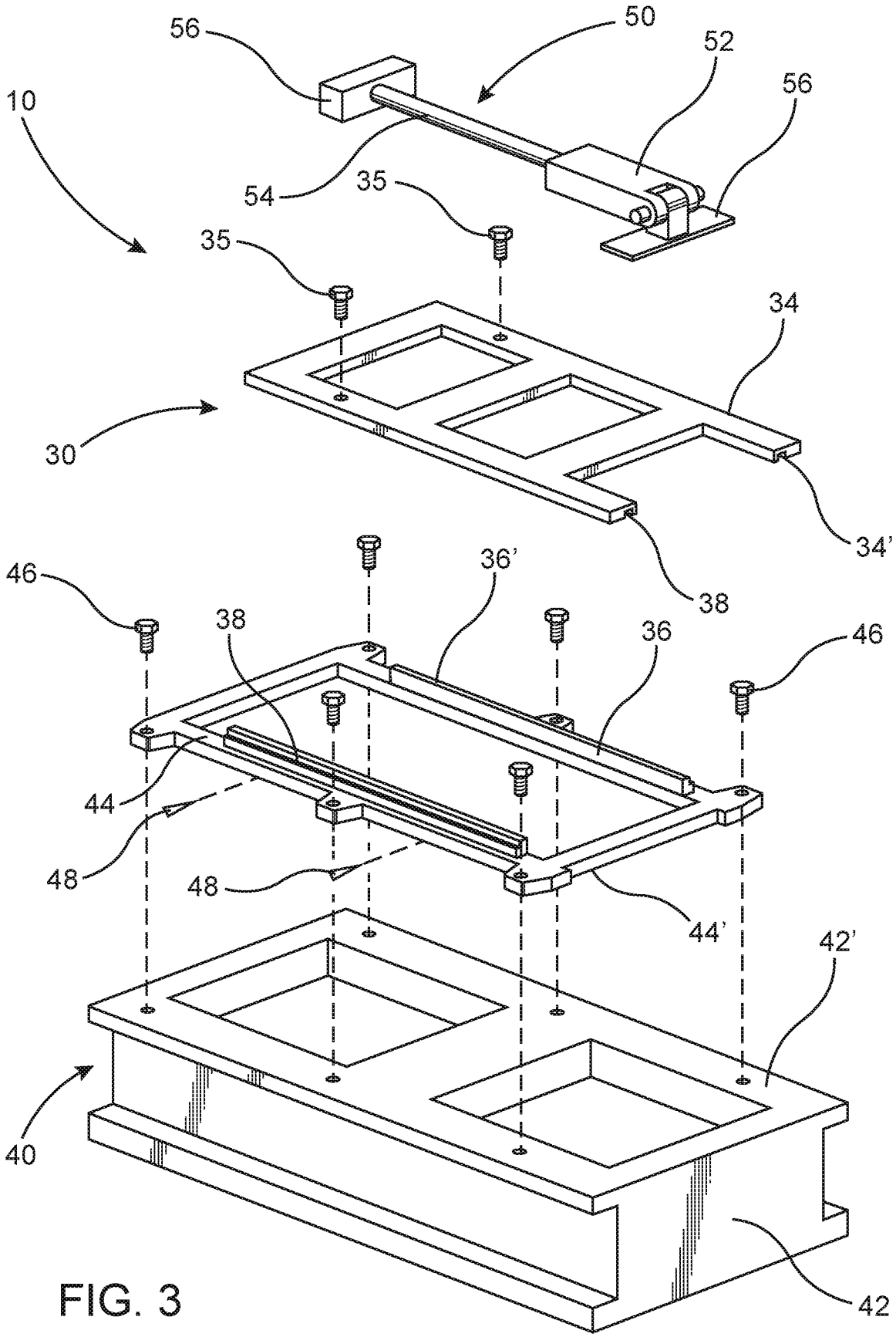
FIG. 3 is an exploded perspective view of one illustrative embodiment of an adjustable sub-base mounting assembly in accordance with of the present invention.

Turning next to the illustrative embodiment of FIG. 3, an exploded perspective view of at least one embodiment of a track assembly 30 and a sub-base assembly 40 in accordance with the present invention is presented. In at least one embodiment of the present invention, a track assembly 30 comprises at least one lower track member 36. With reference to the illustrative embodiment of FIG. 3, a track assembly 30 in accordance with the present invention comprises a plurality of lower track members 36. In at least one embodiment, each lower track member 36 comprises a lower rail 36' extending upwardly therefrom, as discussed in further detail below. As may be further seen from the illustrative embodiment of FIG. 3, each of the plurality of lower track members of 36 is secured to a track support member 44 of a sub-base assembly 40, also discussed in further detail below. As will once again be appreciated by those of skill in the art, a lower track member 36 in accordance with the present invention may be integrally formed with a track support member 44. Alternatively, one or more track members 36 may be securely attached to a portion of a track support member 44 by mechanical means including, but once again not limited to, welding, mechanical fasteners, etc. A lower track member 36 in accordance with the present invention may be constructed from any of a variety of materials once again including, but not limited to, aluminum, steel, stainless steel, 316 stainless steel, engineered composite materials, etc., provided the selected materials exhibit sufficient structural strength to support a pump 20 thereon. As before, in at least one embodiment, a lower track member 36 of a track assembly 30 in accordance with the present invention is constructed of heavy stainless steel having a low carbon content to withstand the harsh corrosive environment in a raw sewage pump station. In one further embodiment, a track support member 44 is also constructed of heavy stainless steel having a low carbon content, once again, to withstand the corrosive environment in a raw sewage pump station. As before, in yet one further embodiment of the present invention, one or both of a lower track member 36 and/or a track support member 44 are also constructed of 316 stainless steel.

Looking again to the illustrative embodiment of FIG. 3, in at least one embodiment, an upper track member 34 comprises at least one upper track 34' dimensioned to movably receive at least a portion of a corresponding lower rail 36' therein. In at least one further embodiment, such as is shown in the illustrative embodiment of FIG. 3, an upper track member 34 comprises a plurality of upper tracks 34', wherein each of the plurality of upper tracks 34' is dimensioned to movably receive at least a portion of a corresponding one of a plurality of lower rails 36' therein. More in particular, the arrangement of upper tracks 34' and corresponding lower rails 36' provides for a sliding engagement between the upper track members 34 and lower track members 36, thereby allowing the pump 20 mounted to the upper tack members 34, via one or more cradles 32, to be slidingly movable relative to the lower track members 36 affixed to the track support member 44 of the sub-base assembly 40. As will be appreciated by those of skill in the art, it is well within the scope and intent of the present invention for an alternate embodiment to comprise one or more "upper rail" and corresponding "lower track", so long as a sliding engagement between the upper track member(s) 34 and lower track member(s) 36 is maintained.

In at least one embodiment of the present invention, one or more of an upper track 34' and/or a lower rail 36' comprises a friction reducing surface 38. With further reference to the illustrative embodiment of FIG. 3, it is noted that corresponding ones of each upper track 34' and lower rail 36' comprise a friction reducing surface 38. In accordance with at least one embodiment of the present invention, a friction reducing surface 38 consists of a layer of ultrahigh molecular weight ("UHMW") polyethylene. As will be appreciated by those of skill in the art, UHMW polyethylene material will not flow out under the weight of the pump 20, such as other known friction reducing materials, for example, TEFLON®. Further, UHMW polyethylene is self-lubricating so as to further facilitate a reduction in the friction between an upper track member 34 and a corresponding lower track member 36, and more in particular, between an upper track 34' and a corresponding lower rail 36', in accordance with the present invention.

In one further embodiment, wherein the components of the track assembly 30 and/or sub-base assembly 40 are constructed of 316 stainless steel, a friction reducing surface 38 may comprise a molybdenum disulfide coating to protect against galling and/or seizing of the upper and lower track members 34, 36. In accordance with at least one embodiment, a molybdenum disulfide coating shall have a tensile strength of 50 KSI at ambient operating temperatures, and in still one further embodiment, a molybdenum disulfide coating shall withstand exposure to moderate acidic conditions, such as may be experienced in a "dry-pit" raw sewage pump station environment. In accordance with at least one embodiment of the present invention, a molybdenum disulfide friction reducing coating 38 comprises NEVER GALL® as manufactured by SCW Associates LLC, Indianapolis, Ind.

Figure 4:
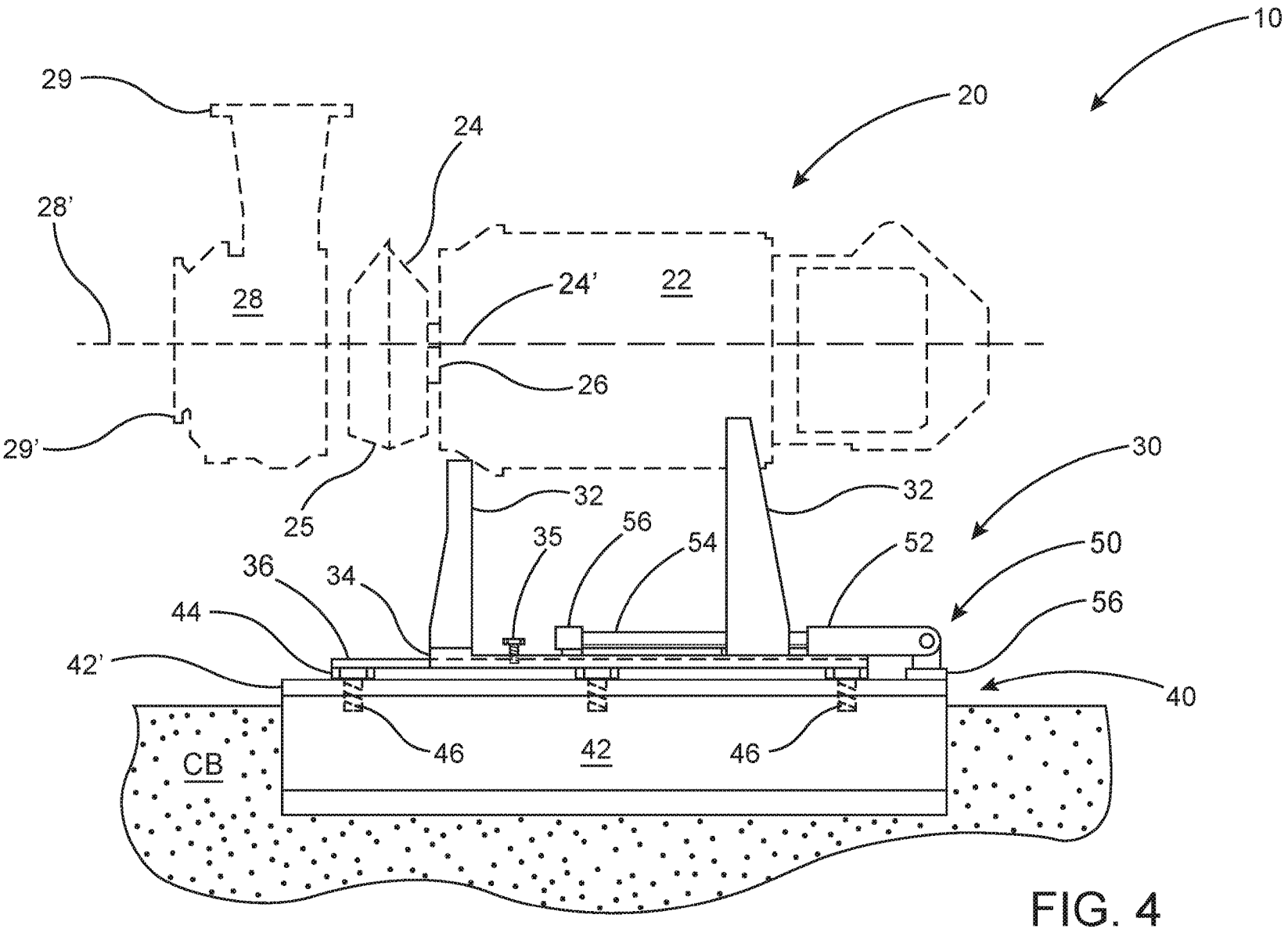
FIG. 4 is a side elevation of a pump mounted on an adjustable sub-base mounting assembly in accordance with one embodiment of the present invention having a rotating unit retracted from the volute to permit maintenance and/or repair.
Figure 5:
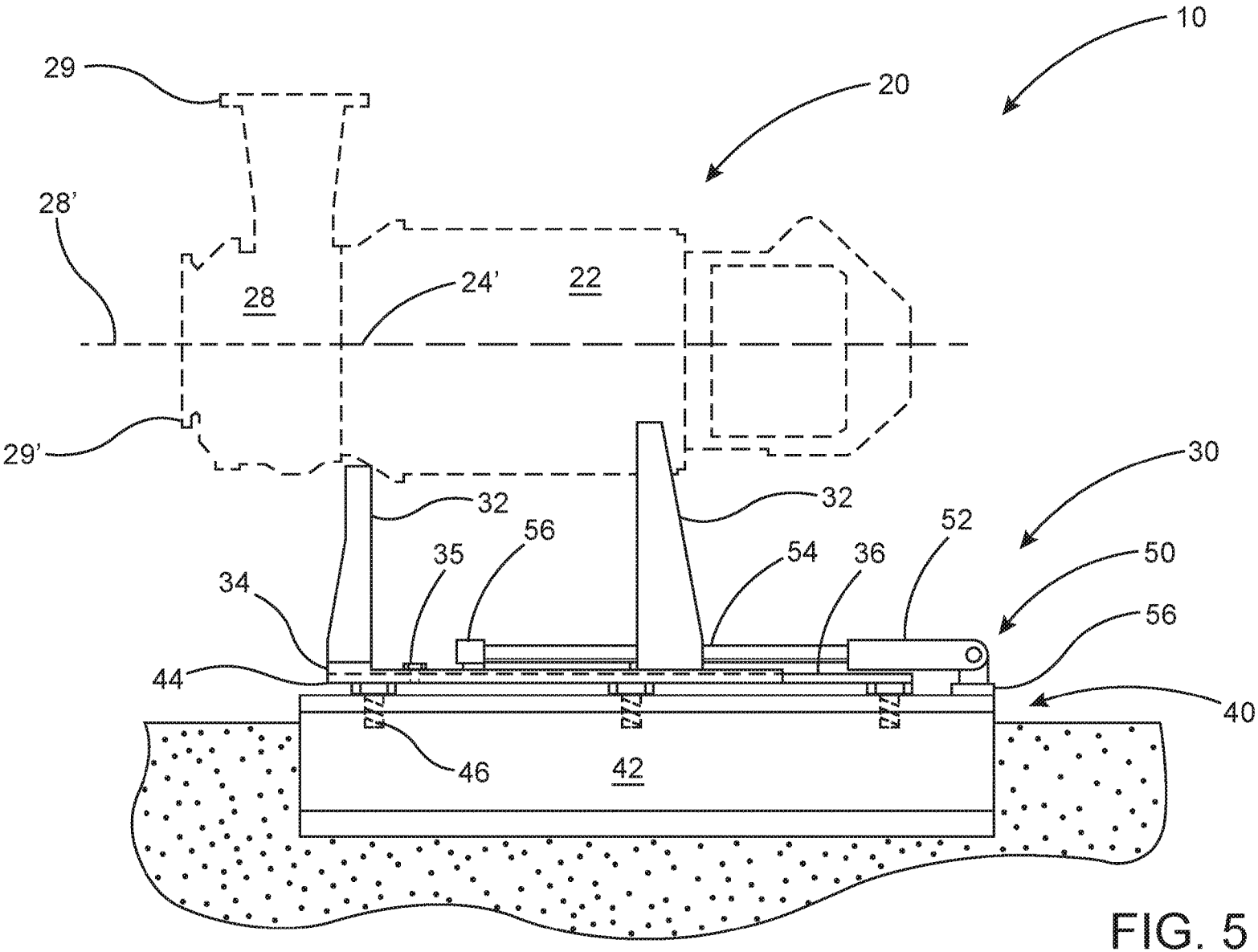
FIG. 5 is a side elevation of the pump of FIG. 4 mounted on an adjustable sub-base mounting assembly in accordance with one embodiment of the present invention having a rotating unit installed in precise alignment with a volute.

In accordance with at least one embodiment, a track assembly 30 comprises at least one lock member 35 to releasably maintain an upper track member 34 in position relative to a corresponding lower track member 36 while a pump 20 is mounted on an adjustable sub-base mounting assembly 10 of the present invention is an operation. Looking once again to the illustrative embodiment of FIG. 3, in at least one embodiment, a track assembly 30 in accordance with the present invention comprises a plurality of lock members 35, each disposable to releasably maintain a corresponding upper track member 34 in an operative position relative to a corresponding lower track member 36, while a pump 20 is operating thereon. More in particular, a lock member 35 in accordance with the present invention is disposable between a locked orientation and a released orientation. FIG. 5 is illustrative of one embodiment of an adjustable sub-base mounting assembly 10 in accordance with the present invention having a lock member 35 disposed in a locked orientation so as to maintain upper track member 34 in position relative to lower track member 36, while the pump 20 is operating thereon, while FIG. 4 is illustrative of a lock member 35 in a released orientation.

With continued reference to the illustrative embodiment of FIG. 3, an adjustable sub-base mounting assembly 10 in accordance with the present invention further comprises a sub-base assembly 40, as noted above, in accordance with at least one embodiment, a sub-base assembly 40 comprises a sub-base 42. As shown in the illustrative embodiment of FIG. 3, a sub-base 42 comprises a generally I-beam cross-sectional configuration. As will be appreciated by those of skill in the art, such an I-beam cross-sectional configuration of a sub-base 42 serves to facilitate securely mounting a sub-base 42 to a concrete base, generally shown as "CB" throughout the figures, in a pump station. As will further be appreciated by those of skill in the art, it is within the scope and intent of the present invention to encompass a sub-base 42 having any of a number of cross-sectional configurations other than an I-beam configuration.

As previously indicated, a sub-base assembly 40 in accordance with the present invention comprises at least one track support member 44. As may be seen, once again with reference to the illustrative embodiment of FIG. 3, a track support member 44 in accordance with at least one embodiment of the present invention is securely mounted to a sub-base 42. In at least one embodiment, one or more jacking bolts 46 are utilized to adjustably secure a track support member 44 to a sub-base 42. More importantly, and as further shown in the illustrative embodiment of FIG. 3, a track support member 44 is adjustably secured relative to the upper surface 42' of the sub-base 42 via a plurality of jacking bolts 46. As used herein, a jacking bolt 46 shall be defined as a bolt which permits adjustment of the vertical distance between an upper surface 42' of a sub-base 42 and a lower surface 44' of a track support member 44. In accordance with at least one embodiment of the present invention, jacking bolts 46 are manufactured of 316 stainless steel, and in one further embodiment, each jacking bolt 46 is treated with a molybdenum disulfide friction reducing coating, so as to prevent galling and/or seizing during operation. As will be appreciated by those of skill in the art, utilization of a plurality of jacking bolts 46 to securely mount the track support member 44 to an upper surface 42' of a sub-base of 42 allows for almost infinite adjustment of the track support member 44 relative to the sub-base 42, such as may become necessary from time to time due to settlement of the concrete base "CB" in the pump station and/or movement of the positon of the intake and/or discharge pipes to and from the pump station, again, such as may occur due to settlement, etc.

More in particular, as will further be appreciated by those of skill in the art, settlement of the concrete base CB within a pump station over time can result in a change in position of a track support member 44 such that a rotating unit axis 24' of a pump 20 is no longer in precise alignment with a volute axis 28', thereby resulting in reduced pump efficiency and/or premature failure of the pump 20 itself. As such, in accordance with at least one embodiment of an adjustable sub-base mounting assembly 10 of the present invention, a plurality of jacking bolts 46 are utilized to adjust the position of the track support member 44 relative to the sub-base 42, such that rotating unit 24, and more in particular, the rotating unit axis 24', may be positioned in precise alignment relative to the volute 28, and again, more in particular, the volute axis 28'. As such, by way of the present invention, a rotating unit 24 can be quickly and easily aligned and/or realigned with a volute 28 of a pump 20, by simply raising or lowering one or more jacking bolt 46, so as to assure efficient operation of the pump 20 and to minimize the potential for premature failure of the same. One or more shims 48 are provided and may be positioned between select portions of a track support member 44 and a sub-base 42 in accordance with the present invention, so as to further assure that the rotating unit 24 is maintained in precise alignment relative to the volute 28.

As will be appreciated by those of skill in the art, absent the combination of a sub-base 42, track support member 44, and one or more jacking bolts 46 in accordance with the present invention, correcting a misalignment of a rotating unit 24 with a volute 28 of a pump 20 requires taking the pump 20 out of operation, removing it from the pump station, levelling the concrete base "CB" within the pump station, and reinstalling the pump 20 such that the rotating unit 24 and the volute 28 are, once again, in precise alignment. The other alternative is to simply allow the pump 20 to operate while the rotating unit 24 and volute 28 are misaligned, such that the pump 20 will operate at a reduced efficiency, which may become a significantly reduced efficiency, and with an increased likelihood of premature failure of the pump itself, which can be costly in terms of pump replacement and downtime of a pumping station.

At least one embodiment of the present invention further comprises a positioning assembly 50. As may be seen from the illustrative embodiment of FIG. 3, a positioning assembly 50 comprises an actuator 52 having a positioning arm 54 extendable outwardly and inwardly therefrom. An actuator 52 in accordance with the present invention may comprise a pump driven actuator, an oil hydraulic actuator, a water cylinder operated actuator, or an air operated cylinder actuator. FIG. 3 further shows that in accordance with at least one embodiment of an adjustable sub-base mounting assembly 10 of the present invention, a positioning assembly 50 comprises a plurality of actuator interconnects 56. More in particular, one actuator interconnect 56 connects the actuator 52 to a portion of a sub-base assembly 40 while the other actuator interconnect 56 connects the end of positioning arm 54 opposite the actuator 52 to a portion of the track assembly 30.

As will be appreciated by those of skill in the art, and with reference to the illustrative embodiment of FIG. 4, when separation of the volute 28 from the pump 20 is required to permit maintenance and/or repair of the rotating unit 24, the bolts securing the volute 28 to the pump 20 are removed, and the positioning assembly 50 is actuated to retract the positioning arm 54 into the actuator 52 which, as noted above, is secured to a portion of a sub-base assembly 40 via one interconnect 56, thereby causing the upper track member 34, to which an opposite interconnect 56 is secured, to move rearward along lower track member 36 toward the actuator 52, thereby separating the volute 28 from the pump 20. More in particular, and as is illustrated best in FIG. 4, upon actuation of the actuator 52, upper track member 34, having cradles 32 secured thereto, slidingly engages lower track member 36 and is moved rearward towards actuator 52, thereby separating the rotating unit 24, which remains secured to the pump 20, from the volute 28, which remains in position securely bolted to the intake and discharge pipes to and from the pump station, respectively.

Under ideal operating conditions, the rotating unit 24 of the pump 20 is disposed in precise alignment with the volute 28 of the pump 20, wherein precise alignment is at least partially defined by a rotating unit axis 24' being disposed substantially parallel to and coincident with a volute axis 28', as further shown in the illustrative embodiments of FIGS. 4 and 5. With reference to the illustrative embodiments of FIGS. 4 and 5, the rotating unit 24 of the pump 20 comprises a rotating unit axis 24' there through which is substantially parallel to upper surface 42' of the sub-base 42 and, at least initially, the concrete base CB. As noted above, over time, the concrete base CB may settle and/or the position of the intake or discharge piping (not shown) to the pump station may shift, thereby resulting in misalignment of the rotating unit 24 and the volute 28 of the pump which, once again, left uncorrected, can result in reducing operating efficiency, potentially substantial, and/or premature failure of the pump 20. In accordance with the present invention, one or more jacking bolts 46 may be operated to raise or lower portions of a track support member 44 such that the rotating unit 24 of the pump 20 is repositioned in precise alignment with the volute 28 of the pump, i.e., one or more jacking bolts 46 are operated to raise or lower portions of the track support member 44 such that the rotating unit axis 24' is, once again, disposed coincident with the volute axis 28', as is shown in the illustrative embodiments of FIGS. 4 and 5.

As will be further appreciated by one of skill in the art, the positioning assembly 50 of the present invention facilitates ease of access to the rotating unit 24 for routine maintenance and/or repair, which is often a monumental task when dealing with large capacity submersible pumps. Upon completion of the maintenance and/or repair of the rotating unit 24, or other component of the pump 20, the positioning assembly 50 is actuated to reposition the pump 20 for operation, and the positioning arm 54 will extend outwardly from the actuator 52, which is again connected to a portion of a sub-base assembly 40 via interconnect 56, thereby causing the upper track member 34, also having an opposite interconnect 56 secured thereto, to slidingly engage the lower track member 36, thereby moving the pump 20 forward toward the volute 28, to facilitate repositioning the volute 28 relative to the pump 20 so that they may be secured together via bolts or other appropriate means, after which, the pump 20 is ready to be placed into or back into service.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An adjustable sub-base mounting assembly for installing a pump onto a concrete base which allows for precise alignment of a rotating unit with a volute of the pump, said adjustable sub-base mounting assembly comprising:

a track assembly having at least one cradle attached thereto to receive a portion of the pump therein, said track assembly comprising at least one upper track member, said at least one cradle mounted to said at least one upper track member, said track assembly further comprising at least one lower track member disposed in sliding engagement with said at least one upper track member, a sub-base assembly comprising a sub-base and at least one track support member adjustably mounted to said sub-base, said at least one lower track member secured to said at least one track support member, and at least one jacking bolt adjustably securing said at least one track support member to said sub-base, said jacking bolt allowing for adjustable positioning of said at least one track support member relative to said sub-base, thereby allowing for precise alignment of the rotating unit with the volute of the pump.

2. The adjustable sub-base mounting assembly as recited in claim 1 further comprising a plurality of cradles each attached to said at least one upper track member, said plurality of cradles receive the portion of the pump therein.

3. The adjustable sub-base mounting assembly as recited in claim 1 further comprising a plurality of upper track members, said at least one cradle mounted to at least one of said plurality of upper track members.

4. The adjustable sub-base mounting assembly as recited in claim 3 further comprising a plurality of lower track members each disposed in sliding engagement with a corresponding one of said plurality of upper track members.

5. The adjustable sub-base mounting assembly as recited in claim 1 further comprising at least one lock member, said at least one lock member releasably maintaining said at least one upper track member in position relative to said at least one lower track member.

6. The adjustable sub-base mounting assembly as recited in claim 1 further comprising a plurality of lower track members each secured to said at least one track support member.

7. The adjustable sub-base mounting assembly as recited in claim 1 further comprising a plurality of jacking bolts adjustably securing said at least one track support member to said sub-base, said plurality of jacking bolts allowing for adjustable positioning of said at least one track support member relative to said sub-base, thereby allowing for precise alignment of the rotating unit with the volute of the pump.

8. The adjustable sub-base mounting assembly as recited in claim 1 wherein said precise alignment is at least partially defined by a rotating unit axis disposed substantially parallel to and coincident with a volute axis of the pump.

9. An adjustable sub-base mounting assembly for installing a pump mounted on at least one cradle which allows for precise alignment of a rotating unit with a volute of the pump, said adjustable sub-base mounting assembly comprising:

a track assembly comprising a plurality of upper track members, the at least one cradle attached to at least one of said plurality of upper track members, said track assembly further comprising a plurality of lower track members each disposed in a sliding engagement with a corresponding one of said plurality of upper track members, a sub-base assembly comprising a sub-base and at least one track support member adjustably mounted to said sub-base, each of said plurality of lower track members secured to said at least one track support member, and at least one jacking bolt adjustably securing said at least one track support member to said sub-base, each said jacking bolt allowing for adjustable positioning of said at least one track support member relative to said sub-base, thereby allowing for precise alignment of the rotating unit with the volute of the pump.

10. The adjustable sub-base mounting assembly as recited in claim 9 wherein the at least one cradle is mounted to each of said plurality of upper track members.

11. The adjustable sub-base mounting assembly as recited in claim 9 further comprising a plurality of lock members, each of said plurality of lock members releasably maintaining one of said plurality of upper track members in position relative to a corresponding one of said plurality of lower track members.

12. The adjustable sub-base mounting assembly as recited in claim 9 further comprising a plurality of jacking bolts adjustably securing said at least one track support member to said sub-base, said plurality of jacking bolts allowing for adjustable positioning of said at least one track support member relative to said sub-base, thereby allowing for precise alignment of the rotating unit with the volute of the pump.

13. The adjustable sub-base mounting assembly as recited in claim 12 wherein said precise alignment is at least partially defined by a rotating unit axis disposed substantially parallel to and coincident with a volute axis of the pump.

14. An adjustable sub-base mounting assembly for installing a pump mounted on a plurality of cradles onto a concrete base which allows for precise alignment of a rotating unit with a volute of the pump, said adjustable sub-base mounting assembly comprising:

a track assembly comprising a plurality of upper track members, each of the plurality of cradles attached to at least one of said plurality of upper track members, a plurality of lower track members each disposed in a sliding engagement with a corresponding one of said plurality of upper track members, a sub-base assembly comprising a sub-base securely mounted to the concrete base, at least one track support member adjustably secured to said sub-base, each of said plurality of lower track members secured to said at least one track support member, and a plurality of jacking bolts adjustably securing each of said plurality of track support members to said sub-base, said plurality of jacking bolts allowing for adjustable positioning said at least one track support member relative to said sub-base, thereby allowing for precise alignment of the rotating unit with the volute of the pump, wherein said precise alignment is at least partially defined by a rotating unit axis disposed substantially parallel to and coincident with a volute axis of the pump.

15. The adjustable sub-base mounting assembly as recited in claim 14 further comprising at least one shim disposed between said at least one track support member and said sub-base to maintain the precise alignment of the rotating unit with the volute of the pump during operation.

16. The adjustable sub-base mounting assembly as recited in claim 14 further comprising a plurality of shims disposed between said at least one track support member and said sub-base to maintain the precise alignment of the rotating unit with the volute of the pump during operation.

17. The adjustable sub-base mounting assembly as recited in claim 14 wherein at least one of said plurality of lower track members or said corresponding one of said plurality of upper track members comprises a friction reducing surface.

18. The adjustable sub-base mounting assembly as recited in claim 17 wherein said friction reducing surface is self-lubricating.

19. The adjustable sub-base mounting assembly as recited in claim 18 wherein said friction reducing surface comprises an ultra-high molecular weight polyethylene composition.

20. The adjustable sub-base mounting assembly as recited in claim 14 wherein said friction reducing surface comprises a molybdenum disulfide coating.

* * * * *